US006213164B1

(12) United States Patent
Ostermayer et al.

(10) Patent No.: US 6,213,164 B1
(45) Date of Patent: Apr. 10, 2001

(54) PINTLE SEAMED PRESS FELT

(75) Inventors: Volker Ostermayer, Greenville; Norbert Reuther, Pelzer, both of SC (US)

(73) Assignee: Geschmay Corporation, Greenville, SC (US)

( * ) Notice: Subject to any disclaimer, the term of this patent is extended or adjusted under 35 U.S.C. 154(b) by 0 days.

(21) Appl. No.: 09/266,546

(22) Filed: Mar. 11, 1999

(51) Int. Cl.[7] ..... D21F 3/00; D21F 1/12; D03D 13/00; D03D 3/04; F16G 3/02

(52) U.S. Cl. ..... 139/383 AA; 442/270; 162/904

(58) Field of Search ..... 139/383 AA; 428/193; 442/225, 270; 162/904

(56) References Cited

U.S. PATENT DOCUMENTS

| | | | | |
|---|---|---|---|---|
| 4,141,388 | * | 2/1979 | Romanski et al. | 139/383 AA |
| 4,418,726 | * | 12/1983 | Josef et al. | 139/383 AA |
| 4,698,250 | | 10/1987 | Talonen et al. . | |
| 4,824,525 | | 4/1989 | Penven . | |
| 4,842,925 | | 6/1989 | Dufour et al. . | |
| 4,856,562 | * | 8/1989 | Dufour | 139/383 AA |
| 4,863,786 | | 9/1989 | Green et al. . | |
| 4,883,097 | | 11/1989 | Dufour . | |
| 5,082,532 | * | 1/1992 | Dufour | 139/383 AA |
| 5,799,709 | * | 9/1998 | Shipley | 139/383 AA |
| 5,904,187 | | 5/1999 | Davenport . | |

FOREIGN PATENT DOCUMENTS

| | | |
|---|---|---|
| PCT/US98/06362 | 4/1998 | (WO) . |

* cited by examiner

*Primary Examiner*—Andy Falik
(74) *Attorney, Agent, or Firm*—Pitney, Hardin, Kipp & Szuch LLP

(57) ABSTRACT

A multi-layer press felt for use in a papermaking machine which is formed by way of a pintle seam in at least the innermost layer. The felt includes a needled fibrous layer on at least its outer surface. Each fabric layer comprises MD monofilament yarns interlaced with CMD yarns forming the plurality of fabric layers each having loops at its opposed MD ends. The loops of the first of the fabric layers are intermeshed to receive the pintle forming the seam which forms the felt endless. Each of the loop portions of the at lease second of the fabric layers have a multi-filament stuffer yarn positioned therein.

22 Claims, 2 Drawing Sheets

PINTLE SEAMED PRESS FELT

BACKGROUND OF THE INVENTION

The present invention is directed to a multi-layered press fabric having a pintle connected seam forming it endless.

Seams in multi-layered fabrics which are connected with a pintle are well known throughout the papermaking fabric industry. The problems caused by these seams are also well known. For example, where multiple pintles are used, the problem of uneven compression at the seam due to the presence of the non-compressible pintles is a concern. Pintle seams also produce support surface areas at the seam which have uneven density causing the paper product to be marked. Also, the caliper of fabrics so seamed is sometimes uneven. Various attempts to provide a pintle seam which overcomes some or all of the deficiencies are disclosed in U.S. Pat. No. 4,698,250 to Talonen et al, U.S. Pat. No. 4,824,525 to Penven, and U.S. Pat. No. 4,842,925 to Dufour et al.

The instant invention has for its object a seam construction for a papermaking fabric which provides for more uniform cover over its entire support surface.

Another object of the invention is a seamed papermaking fabric in which the end most transverse yarns are maintained stable during use.

Another object of the invention is a papermaking fabric in which the cover at the seam is substantially uniform of the cover of the remainder of the support surface.

Another object of the invention is the provision of a papermaking fabric in which the caliper remains uniform throughout.

SUMMARY OF THE INVENTION

The invention is directed to a seamed multi-layer press felt for use in a papermaking machine, the seam acting to form the felt endless. The felt includes at least first and second interconnected fabric layers and a needled fibrous layer on at least its outer surface. Each fabric layer comprises MD yarns (machine direction yarns) interlaced with CMD yarns (cross machine direction yarns) to form each layer with a body portion having a row of loops at opposed MD ends thereof. The loops of the first or innermost of the fabric layers are intermeshed and receive a pintle forming the seam which interconnects the opposed MD ends of the first fabric layer. Each of the loops of the remaining fabric layers each have a stuffer yarn or filler positioned therein. The stuffer yarn along with the CMD and MD yarns of the upper fabric layer form a portion of the needled fibrous layer. The press felt is constructed so that each of the at least first and second fabric layers are of different MD length with the first or innermost of the fabric layers being longer than the remaining of the fabric layers. When there are at least three fabric layers, the intermediate layer of the fabric layers may have a MD length greater than the second fabric layer but less than the first fabric layer. In all arrangements each loop of the rows of loops at the opposed MD ends has a stuffer yarn positioned therein with the exception of the loops formed with the first layer. The stuffer yarn may be a multi-filament yarn or a knitted yarn formed of a single multi-filament yarn or of a plurality of multi-filament yarns. The loops of all fabric layers, save the first fabric layer, are juxtaposed, are partially intermeshed, or are intermeshed.

The invention is also directed to a multi-layer papermaking fabric, including at least a felt outer surface which is formed endless by a seam, wherein the fabric includes a plurality of superimposed and interconnected fabric layers including at least an inner and outer layer. Each layer has a plurality of transversely spaced seam forming loops (each having an axes) at its opposed longitudinal ends. The loops of the inner layer are intermeshed with their axes aligned forming a channel across the fabric. A pintle is positioned along these aligned axes interconnecting the opposed rows of loops and forming a seam which forms the fabric endless. The loops of at least the outer layer may be in juxtaposed position with their axes misaligned across the fabric width. The loops of at least the outer layer contain a stuffer or filler yarn. This stuffer yarn along with the fabric forming yarns of at least the outer layer contribute to the formation of the felt. The fabric layers along with the felt are interconnected by needling.

The loops of the inner fabric layer are always intermeshed and formed into a seam. The loops of the remaining fabric layers may be fully intermeshed with their axes aligned, partially intermeshed with their axes misaligned or juxtaposed in end to end engagement. A stuffer yarn is positioned adjacent each of said opposed ends within respective of the loops. The stuffer yarn may be a knit yarn or a multi-filament yarn.

All of the fabric layers may be woven or they may be formed of interconnected coils or they may be selectively formed by any one of these.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Turning now to the drawings, the invention will now be described in more detail.

Figure 1:
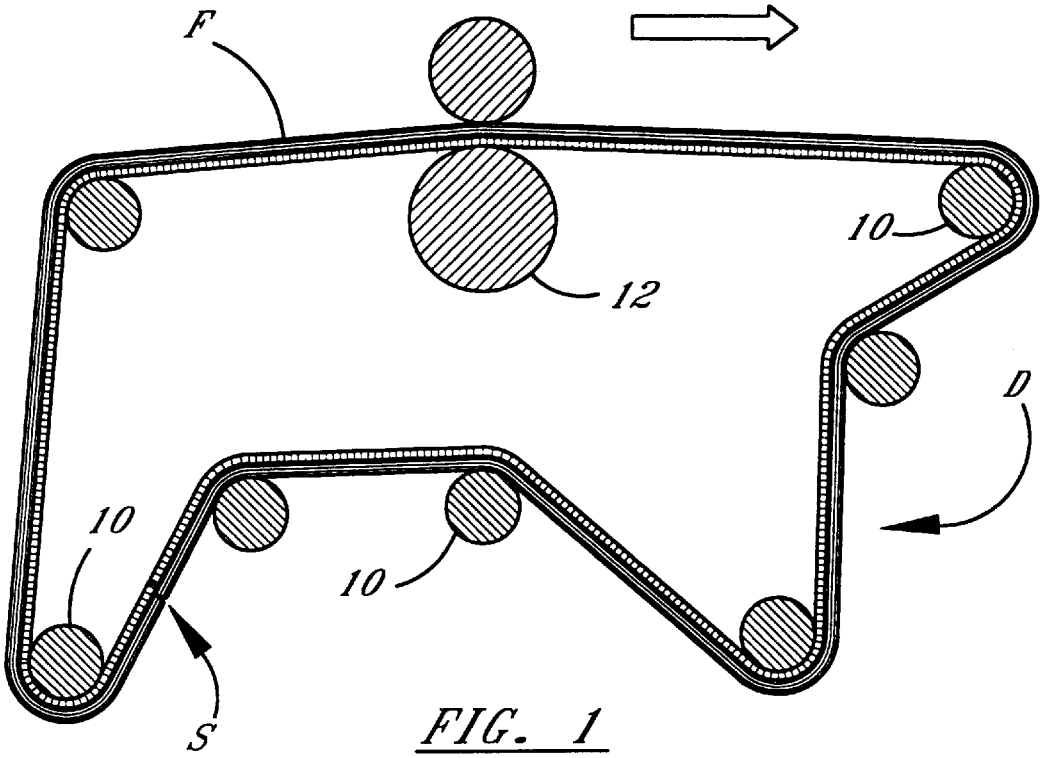
FIG. 1 is a diagrammatic view of the fabric in the press section of a papermaking machine.

FIG. 1 shows a general arrangement for a press section D of a papermaking machine. Press fabric F is shown circulating, in the direction of the arrow, about idler rolls 10 and press rolls 12. Seam S is shown where it connects the opposed ends of press fabric F making it endless.

Figure 2:
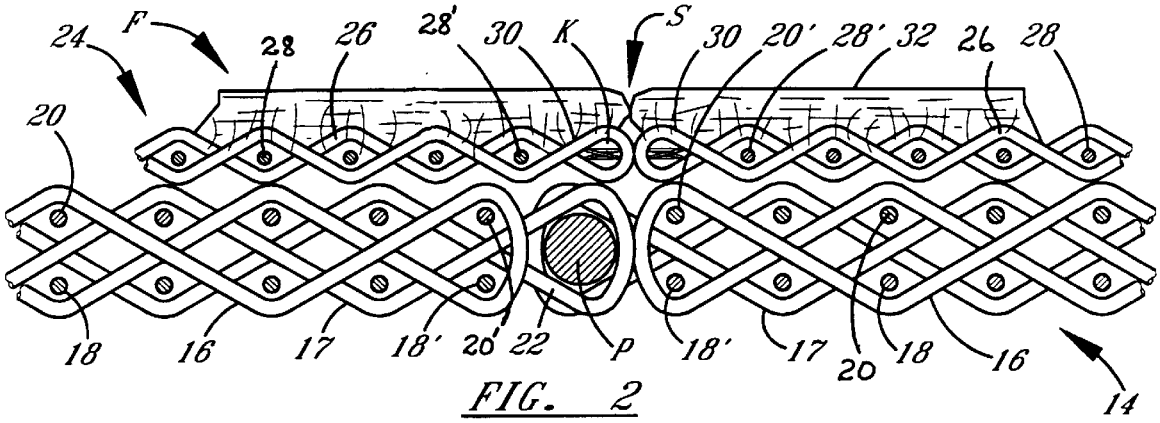
FIG. 2 is a sectional side view of a seam construction for a first embodiment of the invention.

FIG. 2 shows a first embodiment of the invention. Here, fabric F includes lower carrier fabric 14 which is formed as a two layered fabric. Fabric 14 is formed by weft yarns 16 weaving with warp yarns 18,20 and 16 on first and second picks and weft yarn 17 weaving with warp yarns 18 and 20 on third and fourth picks. As weft yarn 20 is picked through warp yarns 18 on a first pick, when it approaches outermost warp yarns 18' and 20', at each side of the fabric, it wraps tightly about these outermost yarns and is picked back through the fabric on a second pick. There are no edge loops formed by first weft yarns 16. Weft yarn 17, where it reaches outermost warp yarns 18' and 20', at each side of the fabric, is looped about a stationary edge wire to form loops 22. Loops 22 are spaced transversely of fabric 14 by first weft yarns 16. To form the finished fabric circular or continuous, loops 22 at the opposed ends of the fabric are intermeshed and pintle P is inserted through the aligned openings. Papermaking fabrics formed endless in this manner are well known.

An upper or support fabric 24 is positioned over the upper surface of carrier fabric 14. Upper fabric 24 is shown as a single layer fabric formed by weft yarns 26 weaving with warp yarns 28 in a known manner. Loops 30 are formed at opposed ends in the manner earlier described. A knit yarn K which acts as a filler or stuffer is inserted through the aligned openings of loops 30 formed at each end of the fabric. In the arrangement shown, knit yarns K may be formed integral with the fabric during weaving. It is noted that fabric 24 may also be a multi-layer fabric.

Upper fabric 24 is formed to be slightly shorter than carrier fabric 14 so that the outer extremities of loops 30 at the opposed ends of the fabric are juxtaposed or in end to end contact. Also, the adjoining ends or loops 30 are preferably, although not necessarily, misaligned vertically of pintle P of the carrier fabric. Upper fabric 24 preferably is united with carrier fabric 14 by needling, although binder yarns or other interlacing techniques may be used.

A fiber batt 32 is provided and is secured with at least the outer surface of upper fabric 24 also by needling.

Knit yarns K serve two primary functions. First, because of the increased length of yarn within the openings due to the knitted configuration more fiber cover may be provided in the area of the seams during the needling operation. The additional fiber cover essentially eliminates the transverse seam line and forms this portion of the outer surface substantially uniform with the remainder of the outer surface. Secondly, knit yarns K within loop 30 maintain yarns 26, where they cross when forming loops 30, in position. By maintaining yarns 26 in position, outermost warp yarns 28' are maintained in position relative to the adjacent transverse warp yarns 28 during use in the press section. By controlling yarns 26, 28' the support surface is maintained even which allows the drainage over the entire area of the upper fabric to be even.

Knit yarns are well known in the art and most constructions are acceptable for use as knit yarn K. U.S. Pat. No. 4,883,097 to Dufour shows a preferred construction for yarn K.

Figure 3:
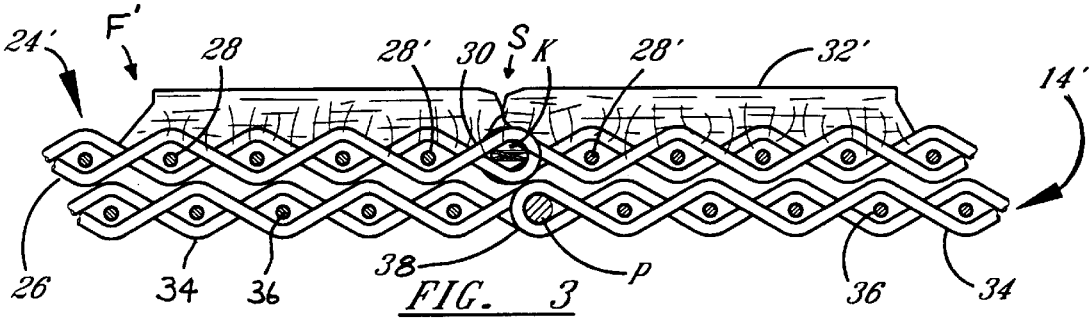
FIG. 3 is similar to FIG. 2 showing a second embodiment of the invention.

Turning now to FIG. 3, a second embodiment in fabric F' is shown. In this arrangement, carrier fabric 14' is formed as a single layer fabric by weaving weft yarns 34 with warp yarns 36 in a desired weave pattern. Loops 38 are formed in alternating sequences at each end of the fabric in the manner earlier described and pintle P is passed through the intermeshed loops 38 to form the fabric endless by way of seam S. Again, this structure is well known.

Upper or support fabric 24' is formed as described above and arranged over the outer surface of carrier fabric 14'. In this arrangement, fabric 24' is formed of a length so that loops 30 intermesh completely with the openings of the loops aligned. Again, loops 30 are arranged to be in slightly misaligned vertically of loops 38 and pintle P of the carrier fabric. A knit yarn K is positioned through the opening formed by intermeshed loops 30 at each end of the fabric as in the earlier described arrangement. A fiber batt 32' is formed over at least the outer surface of support fabric 24 ' by needling.

The fabrics 14' and 24' are preferably united by needling of fiber batt 32' over the outer surface of the upper fabric.

Figure 4:
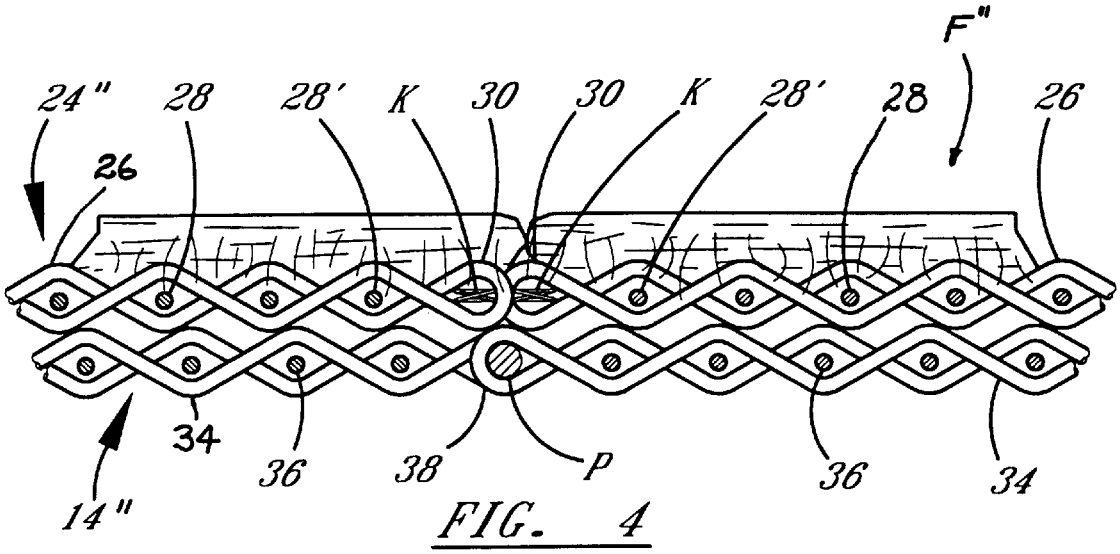
FIG. 4 is similar to FIG. 2 showing a third embodiment of the invention; and, FIG. 5 is a sectional top view of the seam area of a fabric utilizing the seam construction of the invention.

In FIG. 4, the third embodiment is shown as fabric F". This arrangement is very similar to the arrangement shown in FIG. 3. Here fabric F" comprises a carrier fabric 14" formed as described in FIG. 3. Support fabric 24" is also formed as described in FIG. 3. In press fabric F", fabric 24" is formed of a length which causes loops 30 at the opposed ends of the fabric to intermesh only slightly with only the outer ends of loops 30 being intermeshed with fabric 24" is positioned over the outer surface of fabric 14'. This arrangement provides for the openings in each of loops 30 to be laterally spaced requiring an individual knit yarn K for each of the rows of loops 30. The fabrics are united as described in FIGS. 2 and 3.

Figure 5:
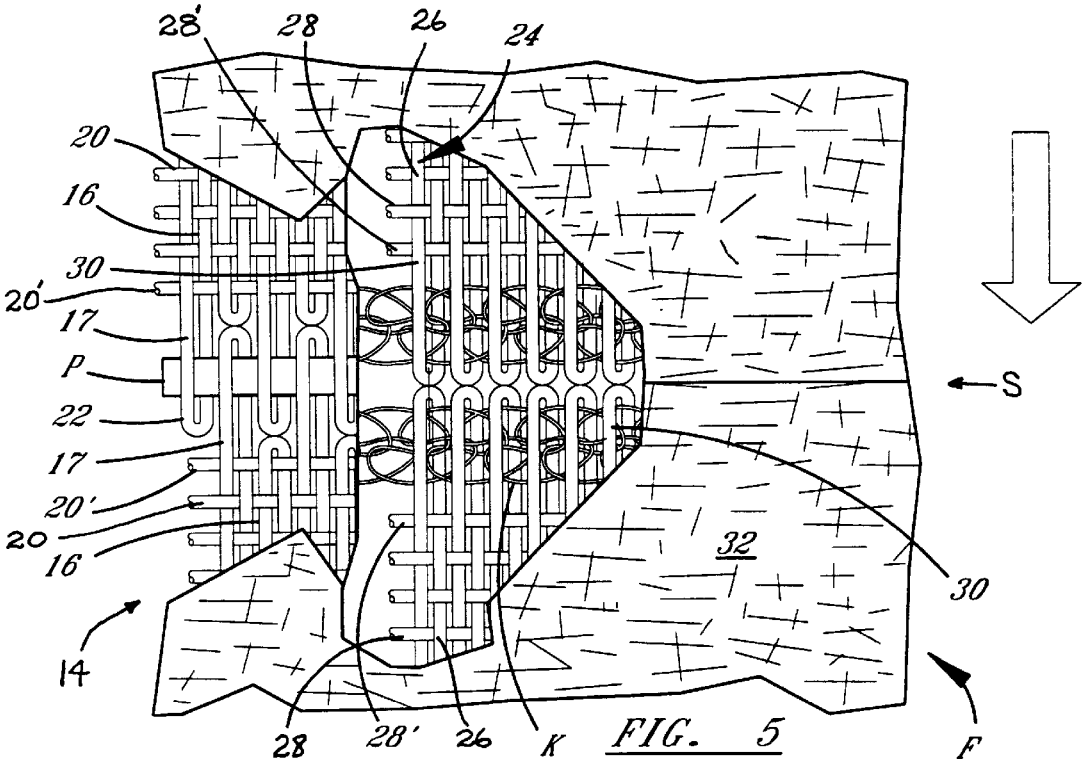

FIG. 5 is a sectional top view of the press fabric of the invention. Here fabric F is shown to include the paper support surface formed by fiber batt 32 on the outer surface of support fabric 24. Support fabric 24 is supported, united with and carried by carrier fabric 14 by needling as earlier described. Fabric F is made continuous by uniting the opposed ends of carrier fabric 14 by intermeshing loops 22 and positioning pintle P through the aligned loop openings forming seam S.

Seam S is substantially obliterated by the cover provided by the needling. The cover includes entangled fibers of knit yarns K, fibers of the forming yarns of support fabric 24, and fibers of fiber batt 32. End loops 30 as well as transverse yarns 28' are maintained in their respective positions by the presence of knit yarns K within loops 30.

Knit yarns K also functions to provide a degree of cushion over seam S and particularly over pintle P. When seam S is pressed against one of drums 12, knit yarn K will flatten out and relieve pressure normally caused by the oversized pintle in seam S. This action allows the caliper of the fabric to remain constant throughout.

The carrier fabric is normally formed of monofilament warp and weft yarns which are wear resistant and which remain stable when subjected to heat and chemicals. The carrier fabric provides lateral and longitudinal stability for fabric F. The upper or support fabric is formed of mono or multi-filament yarns which, when needled, form a uniform fiber batt surface providing even drainage and cover.

While a preferred embodiment of the invention has been described using specific terms, such description is for illustrative purposes only, and it is to be understood that changes and variations may be made without departing from the spirit or scope of the following claims.

What is claimed is:

1. A multi-layer press felt for use in a papermaking machine, said press felt having a seam forming said felt endless, said felt including at least first and second separate, but interconnected, fabric layers on at least an outer surface thereof, each said fabric layer comprising MD yarns interlaced with CMD yarns forming each said layer with a body portion having a row of loops at each MD end; wherein said rows of loops of said first of said fabric layers are intermeshed and carry a pintle forming said seam interconnecting said opposed MD ends of said first fabric layer forming said felt endless; and, a stuffer yarn carried by each row of said loops of said at least second of said fabric layers.

2. The fabric of claim 1 wherein said stuffer yarn forms a portion of said needled fibrous layer.

3. The fabric of claim 1 wherein said first of said fabric layers comprises an innermost layer of said at least first and second fabric layers.

4. The fabric of claim 3 wherein each of said at least first and second fabric layers are of different MD length with said first of said fabric layers being longer than the remaining of said fabric layers.

5. The fabric of claim 4 wherein said fabric layers comprise at least three fabric layers with the intermediate fabric layer of said fabric layers having a MD length greater than said second fabric layer of said fabric layers.

6. The fabric of claim 5 wherein each said row of said loops at each of said opposed MD ends of said second and third fabric layers of said fabric layers carries a stuffer yarn positioned therein.

7. The fabric of claim 1 wherein said stuffer yarn is a multi-filament yarn.

8. The fabric of claim 1 wherein said stuffer yarn is a knitted yarn formed of at least one multi-filament yarn.

9. The fabric of claim 8 wherein said knitted stuffer yarn is formed of a plurality of multi-filament yarns.

10. The fabric of claim 1 wherein a said stuffer yarn comprises a single stuffer yarn which passes through each said row of said loops at said MD ends of at least said second fabric layer of said first and second fabric layers.

11. The fabric of claim 1 wherein there are at least three of said fabric layers and said rows of said loops at said MD ends of at least one remaining fabric layer of said fabric layers are at least partially intermeshed.

12. The fabric of claim 1 wherein there are at least three fabric layers of said fabric layers and said rows of said loops at said MD ends of at least one of said three fabric layers are longitudinally spaced and do not intermesh.

13. The fabric of claim 1 wherein said fabric layers are interconnected by needling.

14. The fabric of claim 1 wherein at least said first of said fabric layers comprises a woven fabric.

15. The fabric of claim 14 wherein said MD yarns of at least said first of said fabric layers comprise weft yarns.

16. A multi-layer papermaking fabric, having at least a felt outer surface, formed endless by a seam, said fabric comprising:

a plurality of superimposed and interconnected fabric layers including at least an inner and outer fabric layer, each said fabric layer having a plurality of spaced seam forming loops at opposed longitudinal ends thereof, said loops at said opposed ends of said inner layer being intermeshed and aligned forming a channel through said fabric;

a pintle, positioned within said channel, forming said seam;

said loops at said opposed ends of at least said outer layer being in juxtaposed position with their openings misaligned;

said loops at said opposed ends of at least said outer layer receiving a stuffer yarn;

said stuffer yarn and said fabric forming yarns of said at least outer layer contributing to the formation of said felt.

17. The fabric of claim 16 wherein said loops at said opposed ends of said at least outer layer are intermeshed.

18. The fabric of claim 16 wherein said superimposed fabric layers include an intermediate layer, said loops at said opposed ends of said intermediate layer being intermeshed and misaligned.

19. The fabric of claim 16 wherein said super-imposed fabric layers includes an intermediate layer, said loops at said opposed ends at each said end of said outer and intermediate layers being juxtaposed.

20. The fabric of claim 19 wherein a stuffer yarn is positioned adjacent each of said opposed ends within respective of said loops.

21. The fabric of claim 16 wherein said stuffer yarn is a knit yarn.

22. The fabric of claim 16 wherein said stuffer yarn is a multi-filament yarn.

* * * * *

UNITED STATES PATENT AND TRADEMARK OFFICE

CERTIFICATE OF CORRECTION

PATENT NO. : 6,213,164 B1
DATED : April 10, 2001
INVENTOR(S) : Volker Ostermayer and Norbert Reuther It is certified that error appears in the above-identified patent and that said Letters Patent is hereby corrected as shown below:

Column 2,
Line 61, change "," to -- and --;
Line 63, change "20" to -- 16 --;
Line 64, after "18" add -- ,20 --.

Signed and Sealed this

Twenty-ninth Day of October, 2002

*Attest:*

*Attesting Officer*

JAMES E. ROGAN
*Director of the United States Patent and Trademark Office*